United States Patent [19]

Cantin et al.

[11] Patent Number: 4,573,414

[45] Date of Patent: Mar. 4, 1986

[54] DEVICE FOR FIXING A TELPHER CHAIR TO A CABLE PROVIDED WITH A TRAVELLING SURFACE FOR ROLLERS

[75] Inventors: Michel Cantin, Pariset; Pierre Jaussaud, Biviers; Roger Olivella, Saint Egreve, all of France

[73] Assignee: Institut National Polytechnique de Grenoble, Grenoble, France

[21] Appl. No.: 632,751

[22] Filed: Jul. 20, 1984

[30] Foreign Application Priority Data

Jul. 21, 1983 [FR] France ..... 83 12098

[51] Int. Cl.[4] ..... B61B 12/12

[52] U.S. Cl. ..... 104/202; 104/223

[58] Field of Search ..... 104/200, 202, 203–208, 104/210, 214, 216, 223

[56] References Cited

U.S. PATENT DOCUMENTS

| | | | |
|---|---|---|---|
| 2,250,339 | 7/1944 | Whittum | 104/200 |
| 3,416,462 | 12/1968 | Pomagalski | 104/210 |
| 3,420,189 | 1/1969 | Wallmannsberger | 104/202 |
| 4,364,314 | 12/1982 | Gaudet | 104/202 |

FOREIGN PATENT DOCUMENTS

| | | | |
|---|---|---|---|
| 863665 | 1/1953 | Fed. Rep. of Germany . | |
| 864406 | 1/1953 | Fed. Rep. of Germany . | |
| 1233699 | 10/1960 | France | 104/202 |
| 2044264 | 2/1971 | France . | |
| 2276970 | 1/1976 | France . | |
| 0014345 | of 1901 | United Kingdom | 104/208 |
| 0245652 | 1/1926 | United Kingdom | 104/208 |

*Primary Examiner*—Robert B. Reeves
*Assistant Examiner*—Dennis C. Rodgers
*Attorney, Agent, or Firm*—Beveridge, DeGrandi & Weilacher

[57] ABSTRACT

Device (1) for fixing a telpher chair or a telpher car to a cable (2), of the type comprising a part (5,6,8) extending along the cable and forming a travelling surface (12) on which rollers (13) are made to travel, the part having at each of its ends an extension (14,15) comprising an arm (16) which extends laterally relative to the cable and along the latter and which forms a travelling surface (22) or ramp which extends the travelling surface (12) of the part in such a way that the rollers (13) mount or leave by means of tangential contact the travelling surface of the extension (14) at its end or in the vicinity thereof.

10 Claims, 2 Drawing Figures

DEVICE FOR FIXING A TELPHER CHAIR TO A CABLE PROVIDED WITH A TRAVELLING SURFACE FOR ROLLERS

The present invention relates to a device for fixing a telpher chair or a telpher car or any other device of the same kind to a cable, of the type comprising a part extending a long the cable and forming a travelling surface on which rollers are made to travel.

In fixing devices of this type known at present, the ends of the said part forming the said travelling surface are located at a distance from the cable. As a result, each time a roller is passed, a vibration occurs on the fixing device when the roller mounts the travelling surface of the said part and a vibration occurs on the cable when the roller leaves this travelling surface.

The object of the present invention is to overcome in particular these disadvantages and to this end a device for fixing a telpher chair or a telpher car of the type mentioned above is proprosed in which the said part forming the said travelling surface comprises at each of its ends an extension comprising an arm which extends, at least in its end part, laterally relative to the cable and along the latter and which forms a travelling surface or ramp which extends the travelling surface of the said part and which extends in such a way that the rollers mount or leave by means of tangential contact the travelling surface of the extension at its end or in the vicinity thereof.

In a variation, the said extension according to the present invention can advantageously comprise two arms which extend, at least at their end parts, on either side of the cable and laterally along the latter, these two arms forming the said travelling surface of the extension as described above.

According to the present invention, the said extension can also comprise a part which extends along the cable and laterally relative to the said arm or arms and which forms with the said arm or arms the travelling surface of the extension. In accordance with the present invention, the internal surface of the said extension adjacent to the cable can be provided with a concave shape so as to match substantially the shape of the cable.

According to the present invention it is advantageous if the shape of the said travelling surface of the extension corresponds substantially, perpendicularly relative to the cable, to the shape of the travelling surface of the said part of the fixing device.

In practice, the device for fixing a telpher car or a telpher chair usually consists of a clamp. As a result, the extension according to the present invention can be provided on the arms of this clamp.

The present invention will be better understood by examining a device for fixing a telpher chair or a telpher car described by way of a non-limiting example and illustrated by the drawing in which.

Figure 1:
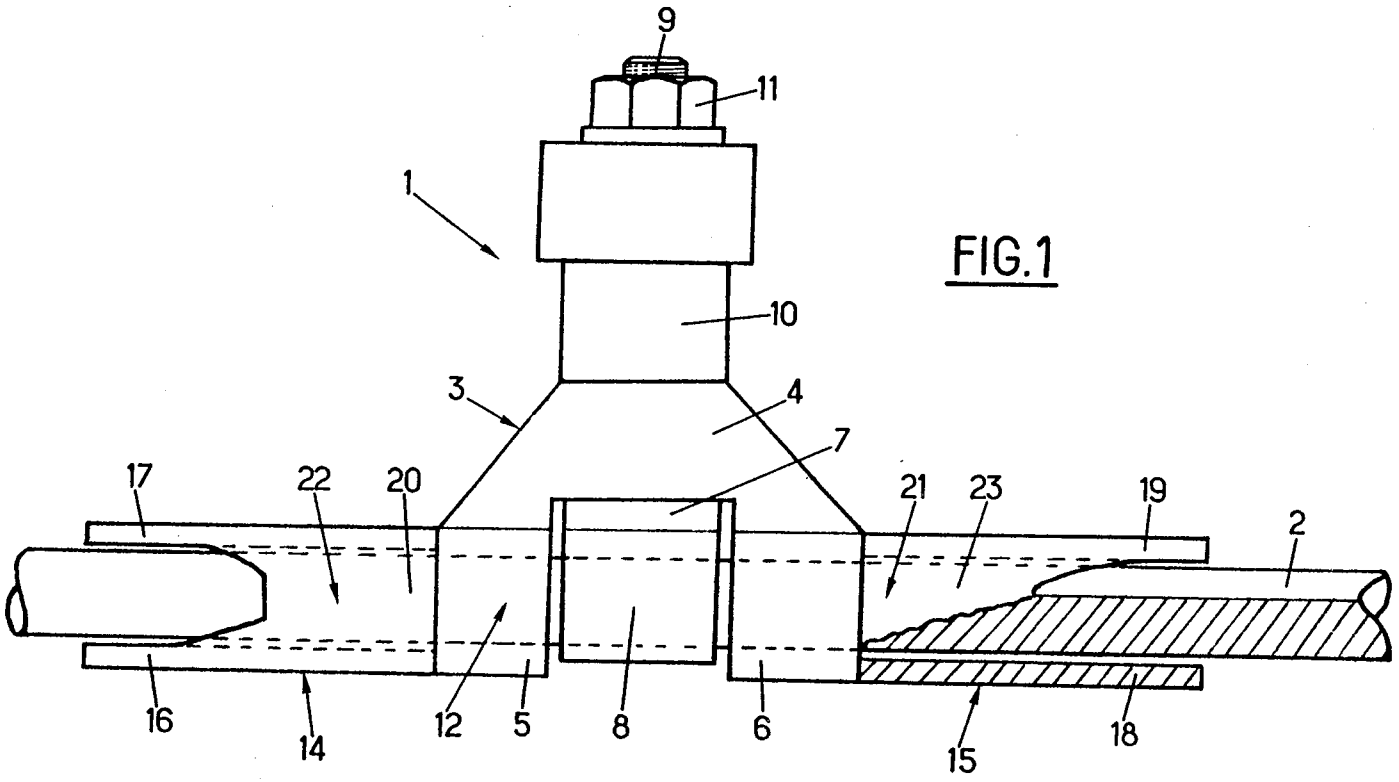
FIG. 1 shows a partially sectioned plan view of a fixing device according to the present invention.
Figure 2:
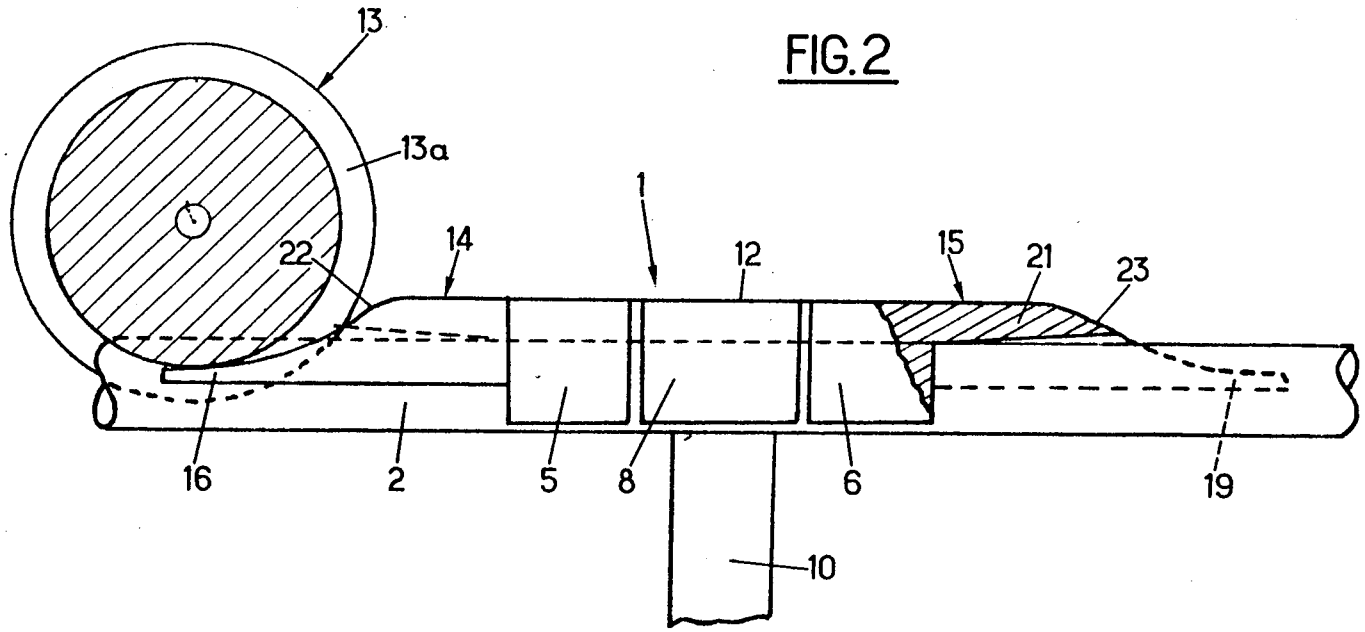
FIG. 2 shows a partially sectioned side view of the fixing device shown in FIG. 1.

The fixing device shown in FIGS. 1 and 2 and indicated in an overall manner by the reference numeral 1 is intended to fix a telpher chair or a telpher car, not shown in the Figures, to a cable 2.

This fixing device 1 is of the clamping type. This clamp is indicated in an overall manner by the reference numeral 3 and comprises a first part 4 which has two end arms 5 and 6 located at a distance from each other and second part 7 which comprises an end arm 8 which extends between the two arms 5 and 6 of the first part 4. The arms 5, 6 and 8 have a recess with a cross-section in the form of a U opening downwards, in which the cable 2 extends in such a way that these arms rest on the cable 2.

The part 7 of the clamp 3 is integrally fixed to a spindle 9 which extends perpendicularly relative to the cable 2 and horizontally, on which part the part 4 is mounted, and which carries the upper end of the arm 10 for suspending the car or telpher chair. The spindle 9 has mounted on its end a nut 11 by means of which the parts 4 and 7 of the clamps 3 can be moved relative to each other and perpendicularly relative to the cable 2 so as to clamp the cable in the recesses of the arms 5, 6 and 8 in order to fix the device 1 to the cable 2.

As can be seen from the Figures, the upper surface of the arms 5, 6 and 8 can form a travelling surface 12 which is parallel to the cable 2 and on which rollers are made to travel, in the manner of the roller 13 which is resting on the cable 2. This travelling surface 12, with regard to its section arranged perpendicularly relative to the cable 2, is rounded so as to match substantially the shape of the groove 13*a* of the roller 13, which groove has a circular cross-section.

The arms 5 and 6 of the clamp 3 have an extension 14 and an extension 15, respectively.

These extensions 14 and 15 extend in opposite directions along the cable 2 and have two arms 16 and 17 and two arms 18 and 19, respectively, which extend laterally relative to the cable and on either side thereof, as well as a middle part 20 and a middle part 21 which connect the arms 16 and 17 and the arms 18 and 19, respectively, and extend above the cable.

The extensions 14 and 15 form a travelling surface or ramp 22 and a travelling surface or ramp 23, respectively, which extend the travelling surface 12 of the clamp 3 and which are inclined relative to the direction of the cable 2 over a section of their length adjacent to the arms 5 and 6 in such a way that their middle part 20 and 21 terminates just above the cable 2 and their arms 16, 17 and 18, 19 extend further laterally relative to the cable 2. Furthermore, the shape, with regard to the section arranged perpendicularly relative to the cable 2, of the travelling surfaces 22 and 23 formed by the extensions 14 and 15 is rounded so as to extend the travelling surface 12 and match substantially the groove 13*a* of the roller 13.

The roller 13 travels over the clamp as follows.

The roller 13, when it reaches the travelling surface 22, first of all comes into contact tangentially with the lateral arms 16 and 17 of the extension 14 in the vicinity of their ends and travels over these arms away from the cable 2. It then travels over that part of the extension 14 which is close to the arm 5 of the clamp 3 and which covers the entire cable 2, and then travels over the travelling surface 12 of the clamp 3, which surface is formed in succession by the upper faces of its arms 5, 8 and 6. On the other side of the clamp 3, the roller 13 travels over the travelling surface 23 of the extension 15 and leaves this extension 15 by means of tangential contact over its arms 18 and 19 in the vicinity of their ends, so as to continue its travel along the cable 2.

It is clear from the above descriptin that the roller 13 can travel over the arms 5, 6 and 8 of the clamp 3 without cauing any vibrations on the clamp 3 or on the cable 2, on account of the extensions 14 and 15.

The present invention is not limited to the example described above. In fact, the extenstons 14 and 15 could be provided on a clamp which is locked by a spring and unlocked automatically by means of a lever.

Furthermore, in certain applications, the arms 16 and 18 of the extensions 14 and 15 could be eliminated in particular so as to allow the cable 2 to bend in the direction away from the arms 17 and 19. In this case, the travelling surfaces or ramps of the extensions 14 and 15 would be formed solely by the arms 17 and 19 and by the middle parts 20 and 21.

Moreover, the extensions 14 and 15 which in the example were integral with the arms 5 and 6 of the clamp 3 could be manufactured separately and assembled on the arms 5 and 6 by means of hinge pins extending perpendicularly relative to the cable 2 so as to be movable vertically.

Many other variations of embodiment are possible without going outside the scope of the present invention as defined by the attached claims.

We claim:

1. A device for fixing a telpher chair or a telpher car to a cable, on which grooved rollers have to pass, comprising:

a clamp connecting the telpher chair or car to the cable and defining a first travelling surface for the rollers and a U-shaped recess for receiving the cable, opposing extensions, being connected to the opposing ends of the clamp, for defining second travelling surfaces on either side of the first travelling surface, each of said opposing extensions including at least one arm extending laterally relative to the cable and along the same side of the cable, said second travelling surfaces each having a ramp portion defined by said arms, whereby the rollers, rolling over the cable and passing over the clamp, tangentially contact one of said second travelling surfaces at one of said ramps, and thereby leave the cable tangentially, the roller travelling on said second travelling surface away from the cable and contacting the first travelling surface, the roller reaching the end of the first travelling surface and said opposing second travelling surface, then travelling on said opposing second travelling surface toward the cable and tangentially leaving said opposing second travelling surface and returning to tangential contact with the cable at said ramp corresponding to said opposing second travelling surface wherein said ramps are concave.

2. The device as claimed in claim 1 wherein the first and said second travelling surfaces are convex so as to substantially match the arc of the cable.

3. The fixing device as claimed in claim 2 wherein each of said extensions comprise a central portion extending over the cable, said arms extending from said central portion.

4. The fixing device as claimed in claim 3 wherein the shape of said second travelling surfaces correspond substantially, perpendicularly relative to the cable, to the shape of the first travelling surface, said extensions substantially matching the groove of the rollers.

5. The device as claimed in claim 4, wherein the first travelling surface and said second travelling surfaces are in opposition to the U-shaped recess of the clamp.

6. The device as claimed in claim 4, wherein each of said extensions includes a pair of said arms.

7. A device for fixing a telpher chair or a telpher car to a cable, on which grooved rollers have to pass, comprising a clamp connected to said telpher chair or car and having a recess which has a cross-section substantially in the form of a U opening downwards and in which the cable extends and is pinched, said clamp having a travelling surface for the rollers, said clamp having two opposed extensions connected respectively to the opposed end parts thereof, these extensions having surfaces forming travelling surfaces extending said travelling surface of said clamp, said opposed extensions comprising respectively a pair of arms, the arms of each pair of arms extending laterally to the cable and along either sides of the latter, the respective surfaces of said pairs of arms of said extensions, forming the said travelling surfaces of the latter, being formed as ramps in such a way the rollers mount or leave by means of tangential contact the travelling surfaces of said pairs of arms of said extensions at their end or in the vicinities thereof, whereby rollers rolling on the cable and having to pass over said clamp, come into contact tangentially with the traveling surfaces of the arms of one of said pairs of arms and so leave the cable tangentially, travel on this travelling surface of this pair of arms away from the cable for reaching the travelling surface of said clamp, travel on the travelling surface of the clamp, travel on the travelling surface of the other pair of arms towards the cable and leave these arms tangentially with the travelling surfaces thereof and so come into contact with the cable tangentially wherein said ramps are concave.

8. Fixing device of claim 7, wherein the said opposed extensions comprise also respective central parts extending over the cable between the corresponding pairs of arms and having respective upper surfaces forming with the respective upper surfaces of said pairs of arms said travelling surfaces of the extensions, the rollers reaching or leaving the travelling surface of each central part after coming in contact with the travelling surfaces of the corresponding pair of arms or before leaving the travelling surfaces of the corresponding pair of arm.

9. Fixing device as claimed in claim 8, wherein the shape of the travelling surfaces of the said extensions correspond substantially, perpendicularly relative to the cable, to the shape of the travelling surface of the said part of the clamp, the travelling surfaces of said clamp and said extensions thereof being formed so as to match substantially the groove of the rollers.

10. Fixing device as claimed in claim 9, wherein said travelling surfaces of the clamp and of the extensions are provided on their surfaces opposed to the U-opening of the clamp.

* * * * *